US005152409A

United States Patent [19]

Sommerfeld

[11] Patent Number: 5,152,409

[45] Date of Patent: Oct. 6, 1992

[54] DRAFT GEAR ASSEMBLY

[75] Inventor: Howard R. Sommerfeld, Oak Forest, Ill.

[73] Assignee: Westinghouse Air Brake Company, Wilmerding, Pa.

[21] Appl. No.: 631,800

[22] Filed: Dec. 21, 1990

[51] Int. Cl.[5] ..... B60G 15/04

[52] U.S. Cl. ..... 213/32 C; 213/33

[58] Field of Search ..... 213/32 C, 32 R, 31, 213/32 A, 22, 33, 34

[56] References Cited

U.S. PATENT DOCUMENTS

| | | | |
|---|---|---|---|
| 2,916,163 | 12/1959 | Campbell | 213/32 R X |
| 2,925,924 | 2/1960 | Morley | 213/32 R |
| 3,178,036 | 4/1965 | Cardwell | 213/33 |
| 3,447,693 | 6/1969 | Cardwell | 213/32 R X |
| 4,305,514 | 12/1981 | Zanow et al. | 213/32 R X |
| 4,576,295 | 3/1986 | Carlstedt | 213/32 R |
| 4,645,187 | 2/1987 | Kanjo et al. | 213/33 X |
| 4,735,328 | 4/1988 | Carlstedt | 213/32 R X |
| 4,809,419 | 3/1989 | Loonam | 213/32 C X |
| 4,960,215 | 10/1990 | Carlstedt | 213/32 R X |

*Primary Examiner*—Margaret A. Focarino
*Assistant Examiner*—Joseph D. Pape
*Attorney, Agent, or Firm*—J. O. Ray, Jr.

[57] ABSTRACT

The present invention discloses a friction-type draft gear assembly including a housing having a front and a rear portion. A compressible cushioning element is positioned within the rear portion with a seating arrangement abutting one end thereof. A friction cushioning element is provided in the front portion of the housing. The assembly further includes a spring release mechanism for continuously urging the friction cushioning element outwardly from the compressible cushioning element thereby releasing such friction cushioning element after compression of such draft gear assembly.

19 Claims, 3 Drawing Sheets

DRAFT GEAR ASSEMBLY

FIELD OF THE INVENTION

The present invention relates, in general, to friction-type draft gear assemblies for use in cushioning both buff and draft shocks normally encountered by railway rolling stock during make-up and operation of a train consist on a track structure and, more particularly, this invention relates to a friction-type draft gear assembly that is lighter in weight and which retains substantially the same shock absorbing capability and is substantially less sensitive to undesirable environmental conditions that will be normally encountered during use of such friction-type draft gear assembly.

BACKGROUND OF THE INVENTION

Friction-type draft gear assemblies have been in widespread use in the railroad industry for many years to absorb both buff and draft shocks applied to the railway rolling stock. Many of such draft gear assemblies which were in use, prior to the present invention, are taught in U.S. Pat. Nos. 2,916,163; 3,178,036; 3,447,693 and 4,645,187. Each of the above-identified patents is owned by the assignee of the present invention. The teachings of each of these patents are all incorporated into the present application by reference thereto.

It is known, for example, from U.S. Pat. No. 4,645,187 that to achieve a reduction in the weight of a railway car, regardless of the type of railway car to be considered, it is desirable to reduce the weight of the necessary auxiliary equipment disposed on such railway car to an absolute minimum. Each of the friction-type draft gear assemblies taught in U.S. Pat. Nos. 2,916,163; 3,178,036 and 3,447,693 have a weight of at least 386 pounds. There are a number of significant reasons why such lighter weight draft gear assemblies are desirable in the railroad industry. The first reason is that less energy is required to move the railway car over the track structure. A second reason is that additional pay load may be carried by such car without exceeding a load limit on a particular track structure and without incurring increased energy costs.

However, even though it has been known that such lighter weight draft gear assemblies were desirable for the above reasons, such a lighter weight draft gear assembly only became available with the invention taught in the above referenced U.S. Pat. No. 4,645,187. Nevertheless, regardless of the weight of such draft gear assembly, it must be capable of maintaining the minimum shock absorbing capacity during its service life. This minimum shock absorbing capacity is specified in the standards which have been established by the Association of American Railroads (AAR). See, for example, AAR specification M-901-E. This specification, for example, requires that these draft gear assemblies have a rated capacity of at least 36,000 foot pounds. Also, it is important to note that the action of the friction portion of such draft gear assembly permits this to be accomplished without exceeding a 500,000 pound reaction pressure being exerted on the car sills of a freight car. This is a requirement in order for the quite high energy shocks to be readily handled without upsetting the coupler shank.

Another serious problem that is associated with friction-type draft gear assemblies of all known prior art draft gear is the generally wide variance in the coefficient of friction that normally occurs between the friction elements disposed in such friction portion of the draft gear assemblies. This problem is made even worse by the environmental conditions in which these friction-type draft gear assemblies must operate. In addition to dust and dirt, the moisture present on the components can cause such components to rust if such draft gear assemblies are not in substantially constant use. It should be noted that the capacity of such friction-type draft gear assemblies can be greatly affected by such wide variance in the coefficient of friction of such friction elements.

SUMMARY OF THE INVENTION

The present invention provides a railway car friction-type draft gear assembly. Such draft gear assembly enables buff and draft shocks that are usually encountered in such railway car rolling stock during a coupling operation of such railway car to a train consist. Such buff and draft shocks are also encountered during normal operation of such train consist on a track structure. The draft gear assembly includes a housing member that is closed at a first end thereof by an end wall. The housing member is open at an axially opposed second end thereof. Such housing member has a rear portion adjacent the first end and a front portion adjacent such axially opposed second end. The front portion is in open communication with such rear portion. The housing member has a predetermined length. A compressible cushioning element is centrally disposed within such rear portion of the housing member. One end of such cushioning element abuttingly engages at least a portion of an inner surface of the end wall closing such first end of the housing member. This compressible cushioning element extends longitudinally from such inner surface of such end wall. A positioning means is provided adjacent the inner surface of such end wall at the first end of the housing member. This positioning means centrally maintains such one end of the compressible cushioning element in the rear portion of the housing member during compression and extension of such compressible cushioning element. A seat means is provided which has at least a portion of one surface thereof abuttingly engaged with an axially opposed end of such compressible cushioning element. Such seat means is mounted to move longitudinally within such housing member for respectively compressing and releasing such compressible cushioning element during application and release of a force exerted on such draft gear assembly. A friction cushioning means is positioned at least partially within the front portion of such housing member. The friction cushioning means absorbs energy during a compression of such draft gear assembly. This friction cushioning means includes a pair of laterally spaced outer stationary plate members which have an outer surface and an axially opposed inner friction surface. The outer surface is positioned for engagement with a portion of an inner surface of such housing member. Each of such pair of outer stationary plate members has a Brinell hardness of between about 277 and 321 throughout. Such friction cushioning means further includes a pair of laterally spaced movable plate members of substantially uniform thickness. Each movable plate member has an outer friction surface and an inner friction surface and at least one substantially flat edge disposed intermediate such outer friction surface and such inner friction surface. Such one edge is disposed for engagement with such seat means. At least a portion of such outer friction surface of the movable plate member movably and frictionally engages the inner friction surface of such outer stationary plate member. Each of the movable plate members has a length of between about 7.84 inches and about 8.93 inches. The friction cushioning element also includes a pair of laterally spaced tapered plate members which have an outer friction surface and an inner friction surface. Such outer friction surface of each such tapered plate member movably and frictionally engages at least a portion of the inner friction surface of a respective one of such movable plate members. A pair of laterally spaced wedge shoe members is provided in such friction cushioning means. Such wedge shoe members have at least a portion of an outer friction surface that movably and frictionally engages at least a portion of an inner friction surface of a respective one of such tapered plate members. Each wedge shoe member has at least a portion of one edge thereof which engages such seat means. Further, such pair of wedge shoe members include a portion on an opposed edge thereof having a predetermined taper. The friction cushioning means also includes a center wedge member having a pair of matching predetermined tapered portions which engage such tapered portion of a respective one of such wedge shoe members. The center wedge member initiates frictional engagement of such friction cushioning means and thereby absorbing energy. Finally, such friction cushioning means includes four lubricating means for lubricating at least four predetermined friction surfaces selected from such inner friction surface of such movable plate members, such outer friction surface of such tapered plate members, such inner friction surface of such tapered plate members and the outer friction surface of such wedge shoe members. The draft gear assembly further includes a spring release means engaging and longitudinally extending between the seat means and the center wedge member. Such spring release means continuously urges such friction cushioning means outwardly from the compressible cushioning means to release such friction cushioning element when an applied force compressing such draft gear assembly is removed.

OBJECTS OF THE INVENTION

It is, therefore, one of the primary objects of the present invention to provide a friction-type draft gear assembly which will at least meet the AAR standards while at the same time exhibiting a lighter weight than prior art draft gear assemblies.

Another object of the present invention is to provide a friction-type draft gear assembly having improved lubricity in the friction portion of such draft gear assembly.

Still another object of the present invention is to provide a friction-type draft gear assembly which will not require any modification to present railway rolling stock for installation.

Yet another object of the present invention is to provide a friction-type draft gear assembly which will reduce energy requirements.

A further object of the present invention is to provide a friction-type draft gear assembly which will at least meet or even exceed all AAR requirements, presently in force, even though such friction-type draft gear assembly is lighter in weight.

It is an additional object of the present invention to provide a friction-type draft gear assembly that is less susceptible to undesirable environmental conditions that will be encountered during use of such friction-type draft gear assembly.

In addition to the various objects and advantages of the present invention described above, various other objects and advantages of such friction-type draft gear assembly will become more readily apparent to those persons who are skilled in the railway car design art from the following more detailed description of such invention when this description is taken in conjunction with the attached drawings and the appended claims.

DESCRIPTION OF THE VARIOUS EMBODIMENTS OF THE INVENTION

Figure 1:
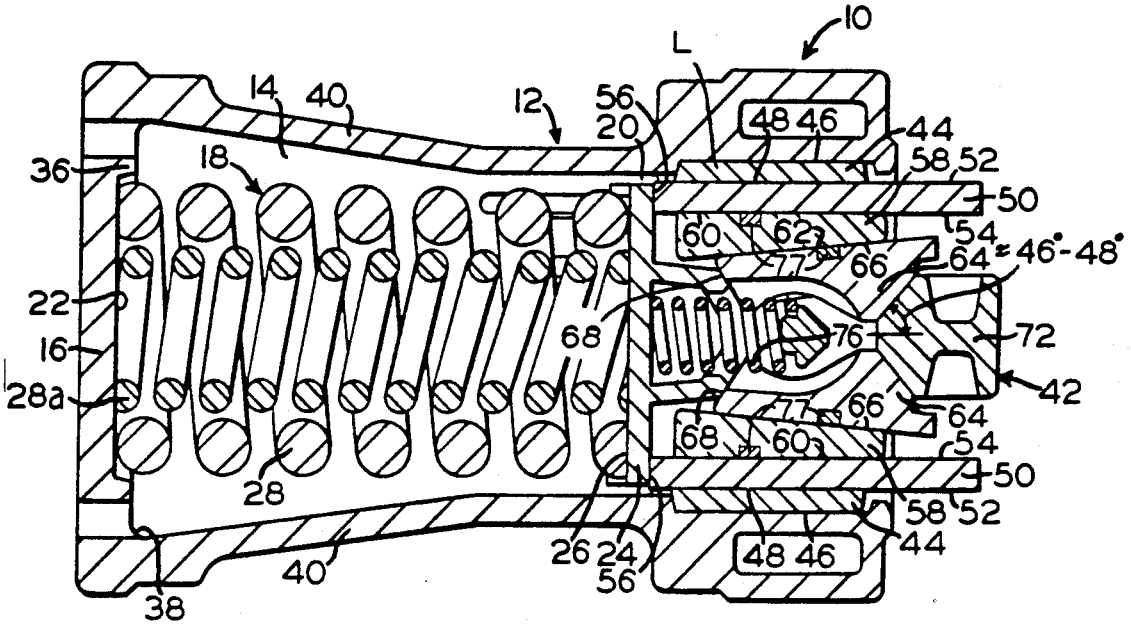
FIG. 1 is a longitudinal cross-sectional view incorporating one form of a presently preferred embodiment of the invented friction-type draft gear assembly.

Prior to proceeding to a more detailed description of the friction-type draft gear assembly according to the present invention, it should be noted that identical components having identical functions have been identified with identical reference numerals throughout the several views of the drawings.

The friction-type draft gear assembly, according to the present invention, is installed in axial alignment with a railroad car center sill member between a front and a rear draft gear lug. A vertically disposed yoke is connected to a coupler shank by a draft key with a coupler horn spaced from a striking plate and with a front follower member within the yoke which is positioned adjacent the front lugs, all substantially in accordance with the prior art conventional practice as illustrated and discussed in the aforementioned U.S. Pat. No. 2,916,163.

Figure 2:
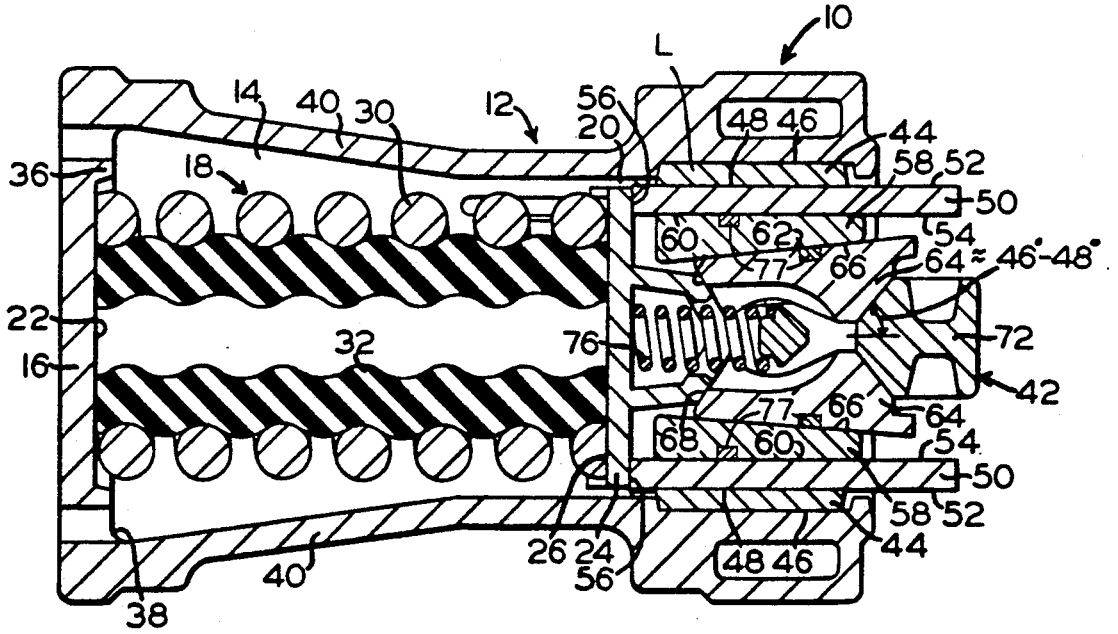
FIG. 2 is a longitudinal cross-sectional view incorporating an alternative embodiment of a compressible cushioning element of another presently preferred embodiment of a friction draft gear assembly assembled according to the present invention.
Figure 3:
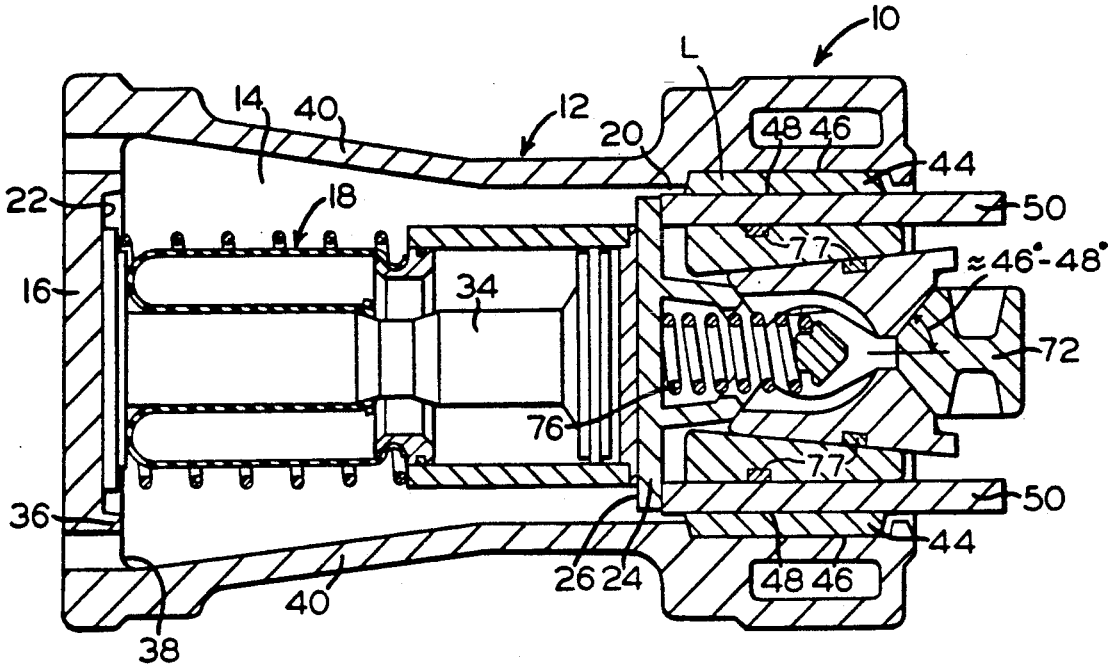
FIG. 3 is a longitudinal cross-sectional view incorporating a hydraulic type cushioning element of another presently preferred embodiment of a friction-type draft gear assembly.
Figure 4:
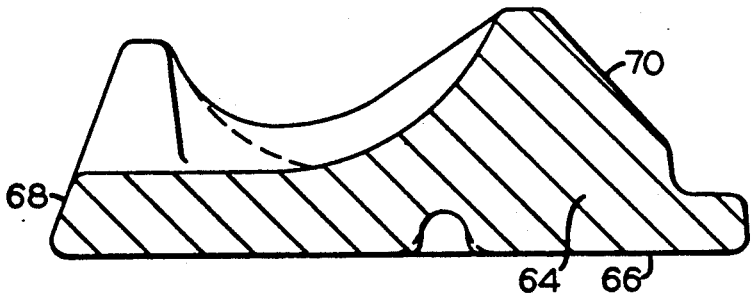
FIG. 4 is a longitudinal view, partially in cross section, of a presently preferred wedge shoe.
Figure 5:
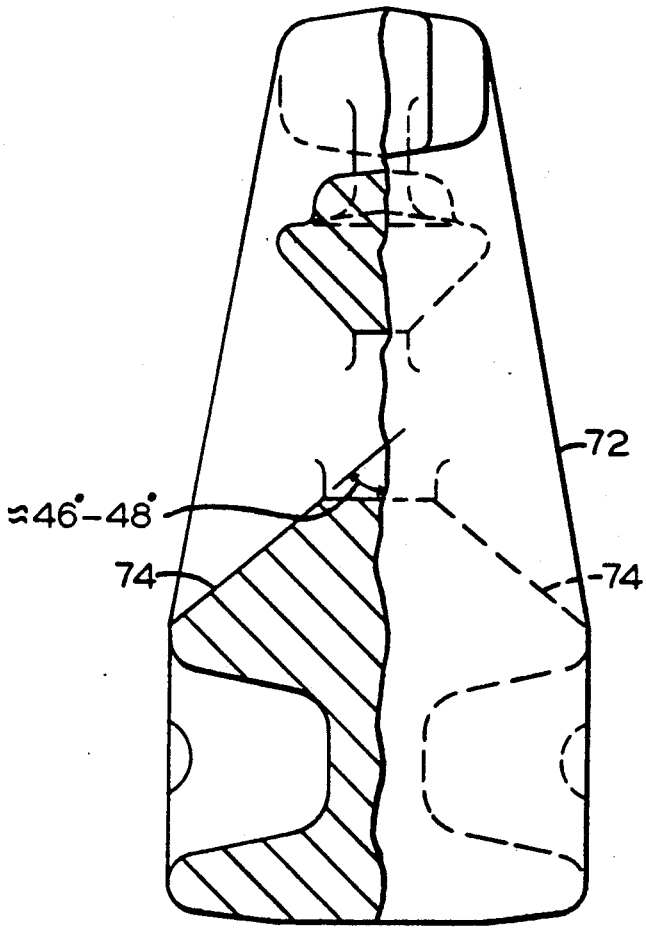
FIG. 5 is a side elevation view partially in cross section of the center wedge member used in the friction-type draft gear assembly of the present invention.

Now referring more particularly to the present invention, as illustrated in FIGS. 1–3, the draft gear assembly is generally designated as 10. Such draft gear assembly 10 enables buff and draft shocks that are usually encountered in a railway car during a coupling operation of such railway car to a train consist as well as during normal operation of the train consist on a track structure. Draft gear assembly 10 includes a housing member, generally designated as 12. The housing member 12 is open at a first end thereof and has a rear portion 14 adjacent a bottom or end wall 16 which closes the axially-opposed other end of housing member 12. Rear portion 14 is provided for receiving therein a compressible cushioning means, generally designated as 18. Housing member 12 includes a front portion 20 adjacent the open end. Front portion 20 is in open communication with the rear portion 14. Housing member 12 has a critical predetermined length. Such predetermined length is between about 19.0 inches and about 19.25 inches. Preferably, such length of the housing member 12 will be 19.125 inches.

There is a compressible cushioning element 18 centrally disposed within the rear portion 14 of such housing member 12. Compressible cushioning element 18 has one end thereof abutting at least a portion of an inner surface 22 of the bottom wall 16 of housing member 12. The compressible cushioning element 18 extends longitudinally from the inner surface 22 of such bottom wall 16 where the axially-opposed opposite end is placed into abutting relationship with at least a portion of one surface 26 of a seat means 24. Seat means 24 is positioned within the housing member 12 for longitudinal movement therein for respectively compressing and releasing the compressible cushioning element 18 during an application of and a release of a force on the draft gear assembly 10.

As shown in FIG. 1, the compressible cushioning element 18, according to one embodiment of the invention, comprises at least one and preferably at least two springs 28 and 28*a*. FIG. 2 shows an alternative embodiment for a compressible cushioning element 18 which comprises an outer coil spring 30 and an inner resilient spring 32. Resilient spring 32 may be, for example, rubber or an elastomer such as hytrel. FIG. 3 shows another alternative embodiment of the invention in which the compressible cushioning element 18 is a hydraulic unit 34 such as taught in U.S. Pat. No. 3,447,693.

A compressible cushioning element 18 positioning means 36 is positioned adjacent the end of such cushioning element 18 located adjacent the inner surface 22 of the bottom wall 16 of housing member 12 for maintaining that end of the compressible cushioning element 18 centrally located within the rear portion 14 of housing member 12 during compression and extension of such compressible cushioning element 18. According to one presently preferred embodiment of the invention, the positioning means 36 comprises a built-up portion 38 in the housing member 12 along two opposed sides adjacent the inner surface 22 of the bottom wall 16 and an inner surface of a connecting sidewall 40 of housing member 12. The positioning means 36 is preferably formed as a part of the housing member 12, i.e., as a single piece casting but alternatively such positioning means 36 may be a separate insert if desired.

Such draft gear assembly 10 further includes a friction cushioning means, generally designated as 42, positioned at least partially within the front portion 20 of the housing member 12. The friction cushioning means 42 absorbs energy generated during application of a force which is at least sufficient to cause a compression of the draft gear assembly 10.

The friction cushioning means 42 includes a pair of laterally spaced outer stationary plate members 44 having an outer surface 46 and an opposed inner friction surface 48. The outer surface 46 abuttingly engages a portion of an inner surface of the housing member 12. In addition to other critical factors to be discussed hereinafter, it is also of critical importance for the objectives of the present invention to be met that the outer stationary plate members 44 have a Brinell hardness of between about 277 and 321 throughout. It has been discovered that at a hardness of less than 277 the life of the draft gear assembly 10 was unacceptable. Further, it has been determined that at a hardness of more than 321, the draft gear assembly 10 would not meet the required AAR specifications.

Friction cushioning means 42 also includes a pair of laterally spaced movable plate members 50. Such movable plate members 50 are of substantially uniform thickness. Movable plate members 50 have an outer friction surface 52 and an inner friction surface 54 and at least one substantially flat edge portion 56 disposed intermediate the outer friction surface 52 and the inner friction surface 54. Such flat edge portion 56 is positioned to engage the seat means 24. At least a portion of the outer friction surface 52 movably and frictionally engages the inner friction surface 48 of the outer stationary plate member 44. Each of such movable plate members 50 has a critical length of between about 7.84 inches and about 8.93 inches. In a more preferred embodiment, the length of such movable plate members 50 will be between about 8.25 inches and about 8.65 inches with the most preferred length of such movable plate members 50 being between about 8.34 inches and about 8.44 inches.

The friction cushioning means 42 includes a pair of laterally spaced tapered plate members 58. The tapered plate members 58 include an outer friction surface 60 and an inner friction surface 62. The outer friction surface 60 movably and frictionally engages at least a portion of the inner friction surface 54 of the movable plate member 50.

Friction cushioning means 42 further includes a pair of laterally spaced wedge shoe members 64 which have at least a portion of an outer friction surface 66 movably and frictionally engaging at least a portion of the inner friction surface 62 of the tapered stationary plate member 58. Wedge shoe members 64 have at least a portion of one edge 68 engaging seat means 24 and a predetermined tapered portion 70 on an opposed edge thereof.

A center wedge 72 is provided which has a pair of matching tapered portions 74 for engaging the tapered portion 70 of the wedge shoe member 64 to initiate frictional engagement of the friction cushioning means 42.

It has been discovered that the tapered portions 70 of the wedge shoe members 64 and the tapered portions 74 of the center wedge member 72 which are tapered upwardly and outwardly from a plane intersecting the longitudinal centerline of the draft gear assembly 10 must be controlled within a very close tolerance of between about 46 degrees and 48 degrees, and preferably between about 46.5 degrees and 47 degrees, with the optimum of generally 47 degrees when the compressible cushioning means 18 is either the springs 28 and 28*a* or the combination of a spring 30 and a resilient spring 32. Further, it was discovered that the taper must be about 47 degrees when such compressible cushioning element 18 is a hydraulic unit 34.

In order to meet the AAR requirements for a friction-type draft gear assembly 10 it has been found critical that such friction cushioning element 42 further includes at least four lubricating means 78 for lubricating at least four predetermined friction surfaces. Such four friction surfaces are selected from the inner friction surface 54 of the movable plate members 50, the outer friction surface 60 of such tapered plate members 58, the inner friction surface 62 of such tapered plate members 58 and the outer friction surface 66 of such wedge shoe members 64. Preferably, such lubricating means 78 are brass inserts contained within a groove formed in selected members of the friction cushioning means 42. Such brass inserts are illustrated as being in the wedge shoe members 64 and the tapered plate members 58.

Although not illustrated, such brass inserts could be installed on other surfaces. The criticality resides in the fact that four friction surfaces must be lubricated to achieve the required capacity and beneficial aspects of the present invention. Such four lubrication means must be capable of providing a coefficient of friction of such friction cushioning means 42 in a range of between about 0.38 and 0.24. The preferred coefficient of friction will be between about 0.35 and about 0.25.

A spring release means 76 engages and extends longitudinally between the seat means 24 and the center wedge member 72 for continuously urging the friction cushioning means 42 outwardly from the compressible cushioning means 18 to release the friction cushioning means 42 when an applied force compressing the draft gear assembly 10 is removed.

In operation, the buffing shock is transmitted from the coupler through the front follower to the center wedge member 72, causing it to act through the wedge shoe members 64 and thereby compress all of the cushioning elements simultaneously. These parts will furnish sufficient cushioning for light buffing shocks. After suitable travel, however, the follower will come against the outer ends of the movable plate members 50 introducing energy-absorbing friction between the movable plate members 50 and the stationary plate members 44 which have been pressed together by the action of the wedge shoe members 64. As this action continues, the pressure between the adjacent surfaces of the intercalated plates has been enormously increased due to the fact that the wedge shoe members 64 are loaded against the cushioning mechanism 42. The energy absorption and dissipation through friction and compression of the cushioning mechanism 42 continues until the draft gear assembly 10 is closed including compression of cushioning element 18.

During release of the draft gear assembly 10, the compressible cushioning element 18 is maintained in alignment by the seat means 24.

Although the preferred and various alternative embodiments have been shown and described above, it will be obvious to those persons who are skilled in the railroad draft gear design art that various other modifications and adaptations of the present invention can be made without departing from the spirit and scope of the attached claims.

We claim:

1. A railway car friction-type draft gear assembly which enables the cushioning of buff and draft shocks that are usually encountered in such railway car rolling stock during a coupling operation of such railway car to a train consist and during normal operation of such train consist on a track structure, said draft gear assembly comprising:

(a) a housing member closed at a first end thereof by an end wall and open at an axially-opposed second end thereof, said housing member having a rear portion adjacent said first end and a front portion adjacent said axially-opposed second end, said front portion being in open communication with said rear portion, said housing member having a predetermined length;

(b) a compressible cushioning element centrally disposed within said rear portion of said housing member, one end of said cushioning element abutting at least a portion of an inner surface of said end wall closing said first end of said housing member, said compressible cushioning element extending longitudinally from said inner surface of said end wall;

(c) a positioning means adjacent said inner surface of said end wall at said first end of said housing member for centrally maintaining said one end of said compressible cushioning element in said rear portion of said housing member during compression and extension of said compressible cushioning element;

(d) a seat means having at least a portion of one surface thereof abutting an axially-opposite end of said compressible cushioning element and mounted to move longitudinally within said housing member for respectively compressing and releasing said compressible cushioning element during application and release of a force exerted on said draft gear assembly;

(e) a friction cushioning means positioned at least partially within said front portion of said housing member for absorbing energy during a compression of said draft gear assembly, said friction cushioning means including:

(i) a pair of laterally spaced outer stationary plate members having an outer surface and an axially-opposed inner friction surface, said outer surface engaging a portion of an inner surface of said housing member, said pair of outer stationary plate members having a Brinell hardness of between about 277 and 321 throughout, (ii) a pair of laterally spaced movable plate members of substantially uniform thickness and having an outer friction surface and an inner friction surface and at least one substantially flat edge intermediate said outer friction surface and said inner friction surface, said one edge engaging said seat means, at least a portion of said outer friction surface movably and frictionally engaging said inner friction surface of said outer stationary plate member, each of said movable plate members having a length of between about 7.84 inches and 8.93 inches, (iii) a pair of laterally spaced tapered plate members having an outer friction surface and an inner friction surface, said outer friction surface of each said tapered plate member movably and frictionally engaging at least a portion of said inner friction surface of a respective one of said movable plate members, (iv) a pair of laterally spaced wedge shoe members having an outer friction surface, a bottom edge and an opposed edge, at least a portion of said outer friction surface movably and frictionally engaging at least a portion of said inner friction surface of a respective one of said tapered plate members, and at least a portion of said bottom edge engaging said seat means, said pair of wedge shoe members having a predetermined tapered portion on said opposed edge thereof, (v) a center wedge member having a pair of matching predetermined tapered portions for engaging said tapered portion of a respective one of said wedge shoe members to initiate frictional engagement of said friction cushioning means and thereby absorb energy, and (vi) four lubricating means for lubricating at least four predetermined friction surfaces selected from said inner friction surface of said movable plate members, said outer friction surface of said tapered plate members, said inner friction surface of said tapered plate members and said outer friction surface of said wedge shoe members, and (f) a spring release means engaging and longitudinally extending between said seat means and said center wedge member for continuously urging said friction cushioning means outwardly from said compressible cushioning means to release said friction cushioning element when an applied force compressing said draft gear assembly is removed.

2. A draft gear assembly, according to claim 1, wherein said tapered portion of said pair of wedge shoes and said pair of tapered portions of said center wedge are tapered upwardly and outwardly from a plane intersecting the longitudinal centerline of said draft gear assembly at an angle of between 46 degrees and 48 degrees.

3. A draft gear assembly, according to claim 2, wherein said tapered portions are tapered at an angle of between 46.5 degrees and 47 degrees.

4. A draft gear assembly, according to claim 3, wherein said tapered portions are tapered at an angle of generally 47 degrees.

5. A draft gear assembly, according to claim 2, wherein said compressible cushioning element comprises at least one spring.

6. A draft gear assembly, according to claim 5, wherein said compressible cushioning element further comprises a plurality of springs.

7. A draft gear assembly, according to claim 5, wherein said compressible cushioning element further comprises a resilient spring disposed within said at least one spring.

8. A draft gear assembly, according to claim 1, wherein said compressible cushioning element comprises a hydraulic cylinder.

9. A draft gear assembly, according to claim 1, wherein said housing further comprises a built-up portion along two opposed sides adjacent said inner surface of said closed end and an inner surface of a connecting sidewall of said housing.

10. A draft gear assembly, according to claim 1, wherein said predetermined length of said housing member is between about 19.0 inches and about 19.25 inches.

11. A draft gear assembly, according to claim 10, wherein said length of said movable plate members is between about 8.25 inches and 8.65 inches.

12. A draft gear assembly, according to claim 11, wherein said length of said movable plate members is between about 8.34 inches and about 8.44 inches.

13. A draft gear assembly, according to claim 1, wherein said lubrication means is a brass insert.

14. A draft gear assembly, according to claim 13, wherein said inner friction surface of each said movable plate member is lubricated.

15. A draft gear assembly, according to claim 14, wherein said inner friction surface of each said tapered plate member is lubricated.

16. A draft gear assembly, according to claim 15, wherein a coefficient of friction of said friction cushioning means is between about 0.38 and about 0.24.

17. A draft gear assembly, according to claim 16, wherein said coefficient of friction is between 0.35 and about 0.25.

18. A draft gear assembly, according to claim 7, wherein said resilient spring is one of rubber and elastomeric material.

19. A draft gear assembly, according to claim 18, wherein said resilient spring is rubber.

* * * * *